United States Patent [19]

Bonar

[11] 4,233,708

[45] Nov. 18, 1980

[54] SELF-CLOSING HINGE APPARATUS

[76] Inventor: Thomas G. Bonar, P.O. Box 102, Aguila, Ariz. 85320

[21] Appl. No.: 954,342

[22] Filed: Oct. 25, 1978

[51] Int. Cl.[3] ..... E05F 1/06

[52] U.S. Cl. ..... 16/152

[58] Field of Search ..... 16/152, 153, 154, 156, 16/186, 137, 155; 49/381; 119/155

[56] References Cited

U.S. PATENT DOCUMENTS

| | | | |
|---|---|---|---|
| 129,209 | 7/1872 | Bushnell | 16/152 |
| 823,443 | 6/1906 | Sandham | 16/156 |
| 1,225,899 | 5/1917 | Weber | 16/152 |
| 2,708,286 | 5/1955 | Tollefson | 16/152 X |
| 3,289,988 | 12/1966 | McKenney et al. | 16/156 X |
| 4,136,641 | 1/1979 | Hoffman | 119/155 |

*Primary Examiner*—George H. Krizmanich

*Attorney, Agent, or Firm*—Cahill, Sutton & Thomas

[57] ABSTRACT

A self-closing hinging apparatus includes an upper hinge, a lower hinge and a reinforcing bar welded to both the upper hinge and the lower hinge to maintain them in proper alignment. The leaves of the lower hinge are longer than the leaves of the upper hinge so that the unhinged end of a gate to which the self-closing hinging apparatus is attached is higher when the gate is open than when the gate is closed. The action of gravity on the weight of the gate therefore causes the gate to self-close.

7 Claims, 6 Drawing Figures

SELF-CLOSING HINGE APPARATUS

BACKGROUND OF THE INVENTION

1. Field of the Invention

The invention relates to self-closing hinging apparatus, and particularly to self-closing hinging apparatus for doors or gates and for cattle "triggers".

2. Description of the Prior Art

Numerous self-closing entry barriers such as gates and doors are well known. Hereinafter, the term "gate" refers to any type of hinged movable entry barrier, including those utilized in buildings (commonly called doors) and those utilized with fences (commonly referred to as gates).

Many self-closing gates are automatically closed by action of springs directly attached to the gate frame and to a gate post; other self-closing gates utilize springs constructed integrally with the hinges connecting the gate to the gate post. Yet other types of self-closing gates close due to the action of gravity on the weight of the gate. Various hinging schemes have been utilized to cause gates of the latter type or a portion thereof to be raised when the gate is opened, so that gravity automatically causes the gate to fall back to its initial closed position when the opening force is released. U.S. Pat. Nos. 86,658, 721,327 and 1,035,134 disclose several types of self-closing gates wherein a lower hinge having longer leaves than those of the upper hinge is utilized. However, the hinges disclosed in the above patents are not suitable for heavy gates for a number of practical reasons. One reason is that it is very difficult to install a heavy gate in such a way that the hinge joints of the upper and lower hinges are perfectly aligned. Usually several workers and various props and shims are required to install a heavy gate using prior hinges of the kinds shown in the above patents. This is a serious shortcoming of prior gravity actuated self-closing hinging apparatus, especially for use on large cattle ranches. The cost of installing and maintaining fences and gates on large cattle ranches is very high due to the long "cross-country" distances which must be traveled by horseback or jeep. It is highly desirable for a single person to be able to install or repair gates on a large cattle ranch in order to keep labor costs reasonably low. Another shortcoming of the hinges disclosed in the above patents is that the weight of a heavy gate causes twisting and consequent misalignment of the upper and lower hinges so that the hinge joints become misaligned in a short time even if the hinges are initially properly installed. Adverse weather conditions, deterioration of gate posts, and pushing and shoving of gates by cattle agravate the latter problem. When the hinge joints become misaligned they bind, causing bending of the hinge leaves, and causing high stresses in bolts connecting the hinge leaves to the gate post and the gate. Consequently, prior self-closing hinges frequently break or are torn loose from gate posts as animals pass through self-closing gates. Known spring actuated self-closing hinging apparatus have been found to be inherently unreliable. Large, stiff springs are necessary in such hinges in order to close heavy gates of the type utilized on cattle ranches. This puts great stress on the hinge leaf connections, causing undue wearing of hinge joints and frequent tearing loose of the hinge leaves from gate and gate posts. Further, rusting of the springs aggravates the problems. It is noteworthy that there is no practical way to brace the above disclosed gate utilizing lower hinges with leaves longer than corresponding leaves of upper hinges connected to the gate due to the fact that both lateral and transverse stresses are produced on the hinges when the gate is in the open and closed positions, respectively.

Accordingly, it is an object of the invention to provide an improved self-closing hinging apparatus for gates which are closed due to the action of gravity.

Another object of the invention is to provide improved self-closing hinging apparatus which maintain hinge joints of upper and lower hinges in alignment during installations of a gate.

Yet another object of the invention is to provide a self-closing hinging apparatus which is more reliable and maintenance free than self-closing hinging apparatus of the prior art.

On cattle ranches, devices known as "triggers" are commonly used as one-way gating devices into water hole areas surrounded by fences. Such water hole areas are commonly referred to as "water hole traps". Previous triggers include two fork-like devices horizontally suspended from a horizontal overhead bar supported between two tall fence posts on either side of a passageway through which cattle can pass to reach a water hole. The purpose of the trigger is to trap cattle in a water hole area so that they can be captured for branding, loading in trucks, or herding to a different location. The two fork-like devices of a trigger have tines which are oriented inwardly with respect to the water hole trap area so that the free ends of the tines nearly meet. The fork-like devices can be pushed apart by cattle as they push their way through the trigger. The fork-like devices then swing or flex back to their original closed (or nearly closed) configuration. If the cattle later try to escape from the water trap area through the trigger, they encounter the free ends of the tines, which usually discourage further attempts at passage through the trigger. If the cattle try to force their way through the trigger in the reverse direction, the fork-like devices are pushed more highly closed, thereby preventing passage. However, such prior triggers are unsatisfactory for a number of reasons. Cattle frequently wound themselves on the free ends of the tines. Screw worm infestations frequently occur in the wounds. Damage to the trigger devices is a frequent occurrence, necessitating time consuming, expensive repairs. Cattle who have previously been trapped by prior triggers frequently refuse to pass through them again, even to get to a water hole, especially if they were previously injured in trying to escape through a trigger in the reverse direction. Cowboys have to dismount from their horses in order to pass through prior triggers because of the above described overhead bar.

Still another object of the invention is to provide an improved cattle trigger which is conducive to passage of cattle.

A further object of the invention is to provide a cattle trigger which avoids injury to cattle.

In short, there is an unmet need for improved self-closing hinging apparatus, especially for use on cattle ranches.

SUMMARY OF THE INVENTION

Briefly described, and in accordance with one embodiment thereof, the invention provides a self-closing hinging apparatus for attaching a gate to a vertical post. The hinging apparatus includes an upper hinge having a first hinge joint and first and second leaves attached to the first hinge joint. The first leaf is attached to a first upright edge of the gate and the second leaf is connected to the vertical post. The hinging apparatus includes a lower hinge having a second hinge joint and third and fourth leaves attached to the second hinge joint. The third leaf is attached to the lower part of the first vertical edge of the gate and the fourth leaf is connected to the vertical post. The length of the third leaf is greater than the length of the first leaf by an amount sufficient to ensure that the weight of the gate will cause the gate to automatically close if the upper and lower hinges are attached to the vertical post so that the first and third leaves lie in a plane perpendicular to the gate when the gate is closed.

In one embodiment of the invention, the second and fourth leaves are substantially equal in length to the first and third leaves, respectively, and lie in a plane perpendicular to the gate when the gate is closed. A reinforcing member, such as a steel rod, is rigidly welded to the upper hinge and lower hinge at points immediately adjacent the first and second hinge joints, respectively, to maintain the first hinge joint in aligned relationship with the second hinge joint. In another embodiment of the invention, the second and fourth leaves are relatively short and of approximately the same length. In the latter embodiment of the invention, the second and fourth leaves are rigidly attached to an elongated plate which is attached to the vertical post an an angle selected to ensure that the gate will automatically close at a suitable rate. In this case, the vertical post must be sufficiently wide along its elongated plate mounting surface to permit the gate to be in vertical alignment with the vertical post when the gate is closed.

In one embodiment of the invention, two of the hinging apparatus are utilized to mount two gates, respectively, which gates are suspended to provide barriers to two adjacent passages through a fence to form a pair of cattle triggers. A first one of the gates opens into a fenced-off area (such as a water hole trap) and the second gate opens out of the fenced-off area in response to gentle shoves by cattle attempting to pass through the fence. The weight of each of the trigger gates upon their respective hinging apparatus normally holds each gate closed against a respective stop post with sufficient force to ensure that normal winds will not open the trigger gates. The second gate is latched or otherwise locked closed if it is desired to prevent the cattle from escaping from the fenced-off area.

BRIEF DESCRIPTION OF THE INVENTION

Figure 1:
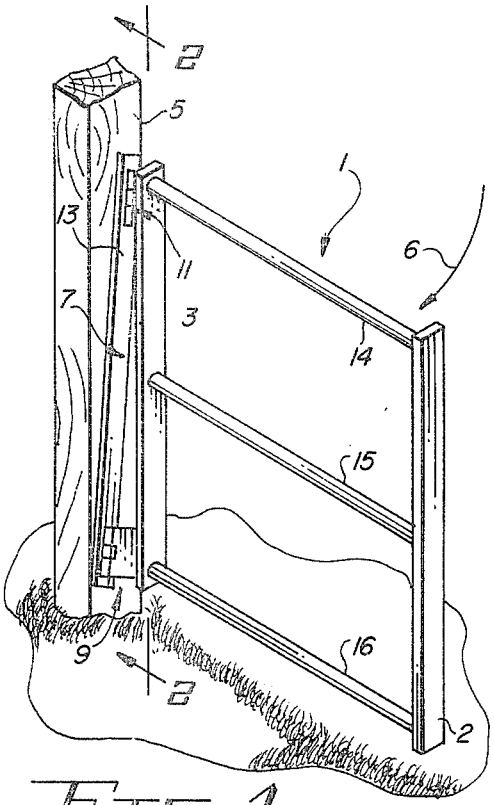
FIG. 1 is a perspective view of one embodiment of the hinging apparatus of the present invention connecting a gate to a vertical post.

Referring now to the drawings, and particularly to FIGS. 1–4, a gate 1 is connected to a vertical post 5 by means of hinging apparatus 7 (as previously mentioned, the term "gate" is used to refer to any type of hinged entry barrier in both the specification and claims of this application). Hinging apparatus 7 includes a reinforcing plate 13 and an upper hinge 11 connected to the upper end of gate upright 3, gate 1 and reinforcing plate 13. Hinging apparatus 7 also includes lower hinge 9, which connects the lower end of gate upright 3 to the lower end of reinforcing plate 13.

Figure 2:
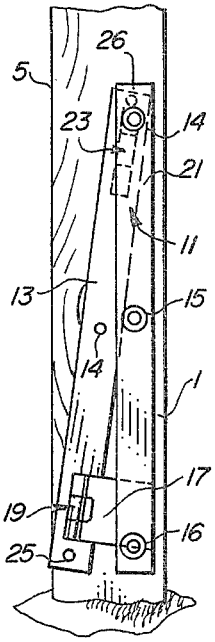
FIG. 2 is a partial section view of the apparatus of FIG. 1 taken along section lines 2—2.
Figure 3:
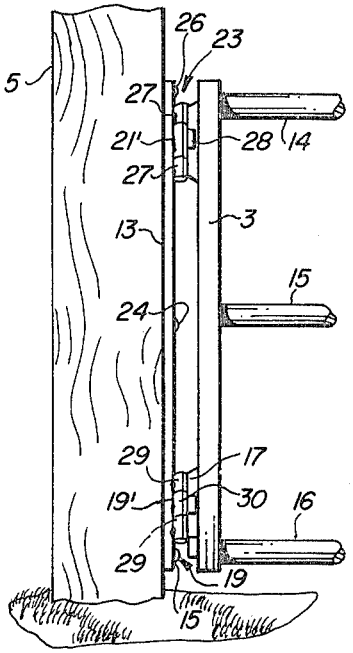
FIG. 3 is a side view of the embodiment of the invention of FIG. 1.

Gate 1 is shown in the closed position in FIGS. 1–3. Gate 1 is opened by swinging it in the direction indicated by arrow 6 (the usual gate stop and/or latch mechanisms have been omitted from gate upright 3 for convenience).

Figure 4:
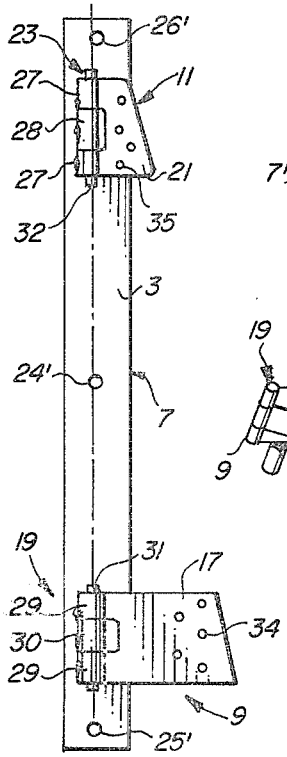
FIG. 4 is a plan view of the hinging apparatus of FIG. 1.

Reinforcing plate 13 is mounted at an angle with respect to the vertical axis of vertical post 5 for reasons which will become clear in the following description. Upper hinge 11 and lower hinge 9 include hinge joints 23 and 19, respectively. Each of the hinges further includes two leaves each connected to the hinge joint. The hinge joints and their respective kingpins are aligned with the axis 22 of reinforcing plate 13, as shown in FIG. 4. More specifically, upper hinge 11 includes hinge joint 23. Hinge joint 23 is connected to leaf 21, which is connected to gate upright 3 and to weld 21', which forms a very short leaf rigidly attaching upper hinge 11 to reinforcing plate 13.

It is noteworthy that leaves 17 and 21 of lower hinge 9 and upper hinge 11, respectively, are connected to gate upright 3 such that leaves 17 and 21 lie in a plane perpendicular to the plane of gate 1.

Referring to FIG. 4, hinge joint 23 is formed by two eyelets 27 attached to leaf 21, eyelet 28 and kingpin 32. Eyelet 28 is attached by means of weld 21' to reinforcing plate 13. Similarly, lower hinge joint 19 is connected to gate upright 3 by means of leaf 17, and to reinforcing plate 13 by means of weld 19', which functions as a short leaf. Hinge joint 19 includes eyelets 29 connected to leaf 19 and eyelet 30 connected by means of weld 19' to reinforcing plate 13.

Reinforcing plate 13 is bolted to vertical post 5 (by means of bolts 24, 25, and 26) at such an angle that gate 1 is vertically aligned with upright post 5 when gate 1 is closed. When gate 1 is opened in the direction indicated by arrow 6 in FIG. 1, it can be seen that the unhinged end of gate 1 is gradually raised due to the above angle and the fact that leaf 17 of lower hinge 9 is substantially longer than leaf 21 of upper hinge 11.

Consequently, if a force tending to open gate 1 is released, the force of gravity upon the weight of gate 1 causes gate 1 to automatically swing or "fall" back to its closed, lower potential energy position, if gate 1 has been opened to an angle which is less than 90° with respect to its closed configuration.

The length of leaf 17 is selected to be sufficiently longer than the length of leaf 21 that gate 1 satisfactorily automatically closes when the above mentioned opening force is removed. It should be noted that for some applications wherein no latch is utilized on the unhinged end of a gate, the lateral component of the gravitational force tending to close gate 1 is of sufficient magnitude to hold gate 1 against a stop post (not shown) despite the presence of ordinary wind forces tending to open the gate. The gate can then be utilized as a self-closing gate which can be pushed open by cattle to permit them to pass through that gate in only one direction.

Still referring to FIGS. 1–3, if gate 1 is swung open to an angle of more than 90° with respect to its closed position, then the force of gravity upon the weight of gate 1 will tend to cause it to swing further open, rather than to close. Thus, if it is desired that gate 1 remain open, one merely has to open it to an angle of more than approximately 90° with respect to its closed position.

If this angle is modified, the "break point angle", i.e. the angle at which gate 1 will tend to remain open rather than automatically closing, will also be modified (the break point angle is 90° for the embodiment of the invention illustrated in FIGS. 1–4).

Leaves 17 and 21 can be welded to gate upright 3 if gate upright 3 is made of iron, or can be bolted thereto by means of holes generally designated by reference numerals 34 and 35 in FIG. 4.

It is noteworthy that hinging apparatus 7 has a number of important advantages, a main one being that reinforcing plate 13 maintains upper hinge 11 and lower hinge 9 in perfect alignment regardless of the weight of gate 1. As previously mentioned, prior hinging apparaus utilizing lower hinges with off-set hinge joints and leaves longer than the corresponding leaves of the upper hinges frequently become misaligned due to the weight of heavy gates. However, since hinges 9 and 11 are welded to reinforcing plate 14, they remain aligned even though the strength of vertical post 5 may gradually deteriorate due to adverse weather conditions, such as the intense dryness and heat of the American Southwest. Maintenance other than oiling of the respective hinge joints is never required. Since hinge joints 19 and 23 always remain aligned, binding of the hinge joints does not occur, and gate 1 never gets "stuck" in the open position. Consequently, the torque on the hinge joints 19 and 23 is never sufficient to bend the leaves of hinges 9 or 11.

Further, it requires far less effort and labor to install a gate utilizing hinging apparatus 7 than if prior self-closing gravity-actuated hinges are utilized, since no effort needs to be made to hold a heavy gate in position while attempting to properly align the upper and lower hinges. However, in accordance with the present invention, one worker may install a very heavy gate utilizing the self-closing hinging apparatus 7. This is an important advantage in ranching operations, since heavy gates frequently need to be installed in very remote areas in order to facilitate rounding up of stray cattle in remote desert careas. Under such circumstances, labor costs would be greatly increased if several workers were required to perform either initial installation or subsequent maintenance on a single gate.

It should be noted that satisfactory utilization of hinging apparatus 7 depends upon availability of a vertical post having a sufficiently wide mounting surface to accommodate the angle at which reinforcing plate 13 must be mounted. However, if only a narrow mounting post is available, the hinging apparatus of FIG. 5 can be readily utilized.

Figure 5:
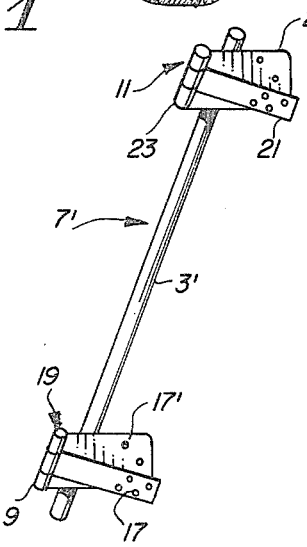
FIG. 5 is a perspective view of an alternate hinging apparatus of the present invention.

Referring now to FIG. 5, hinging apparatus 7' includes upper hinge 11 having two leaves 21 and 21' connected to hinge joint 23. Leaves 21 and 21' are of substantially equal length. Similarly, lower hinge 9 includes leaves 17 and 17' connected to hinge joint 19. Leaves 17 and 17' are of substantially equal length and are longer than the lengths of leaves 21 and 21' by an amount sufficient to ensure production of a satisfactory closing force on a gate to which hinging apparatus 7' is attached due to the action of gravity. Hinge joints 19 and 23 of FIG. 5 are maintained in perfect alignment by means of rigid bar 3', which is welded to leaves 21' and 17' adajcent hinge joints 19 and 23. The embodiment of the invention of FIG. 5 is especially suitable for use with metal gate posts, or for doors of residences, barns or the like. Its advantages are essentially the same as those of the hinging apparatus of FIGS. 1–4.

Figure 6:
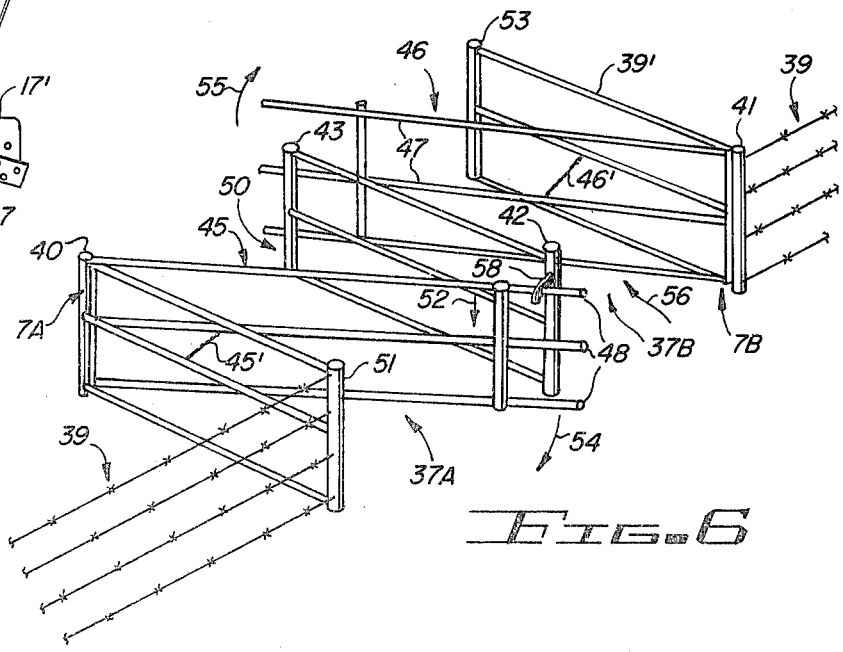
FIG. 6 is a perspective view of a cattle trigger utilizing the self-closing hinging apparatus of the present invention.

Referring now to FIG. 6, a pair of "cattle triggers" employing either of the previously described hinging apparatus is shown. The purposes of cattle triggers are previously described herein. Cattle triggers 37A and 37B are disposed between two sections of barbed wire fence, generally designated by reference numeral 39. The barbed wire 39 on the left side of FIG. 6 is connected to stop post 51. A trigger gate 45 including a plurality of protruding parallel rails 48 is hingeably attached to vertical post 40 by means of a hinging device such as hinging device 7 of FIG. 1–4 or 7' of FIG. 5. The force of gravity upon trigger gate 45 and the action of self-closing hinging apparatus 7A produces a predetermined lateral force pushing gate 45 to its nearly closed position toward top post 42, determined by stag chain 45'. Stop post 42 is located forwardly of vertical post 40 in FIG. 6 and connected thereto by rails 39', which are approximately perpendicular to the plane of barbed wire 39. Rails 50, perpendicular to the plane of barbed wire fence 39, are rigidly connected between stop post 42 and stop post 43, which is located rearwardly of the plane of barbed wire fence 39 in FIG. 6. A second trigger gate 46 having a plurality of protruding rails 47 is hingeably attached to vertical post 41 by means of a second self-closing hinging apparatus 7B, which may also be of the type shown in FIG. 1–4 or FIG. 5. The left portion of barbed wire fence 39 is attached to upright post 41. Trigger gates 45 and 46 are both in their "closed" (i.e. nearly closed) positions shown in FIG. 6. Cattle wishing to pass through cattle trigger 37B in the direction indicated by arrow 56 can walk up to trigger gate 46 and nudge it. Trigger gate 46 will then swing open in the direction indicated by arrow 55, permitting the cattle to pass through the opening between vertical posts 41 and stop post 43. Stop post 53 is positioned to prevent trigger gate 46 from swinging past its "break point" (previously defined) to ensure that trigger gate 46 will automatically close when the cattle have passed through. Once the cattle are on the opposite side of barbed wire fence 39 and cattle trigger 37B, they will be unable to return to the forward side of fence 39 through trigger gate 46 because it is restrained by stop post 43 when nudged by the cattle. Further, it has been found that the protruding ends of parallel rails 47 tend to prevent cattle from nudging the trigger gate 46 in the reverse direction. Latch 58, which is attached to stop post 42, prevents trigger gate 45 from being opened if the cattle try to pass through trigger gate 45 in the direction indicated by arrow 52 unless latch 58 is released. A similar latch (not shown) is attached to the hidden side of stop post 43. Thus, the direction in which cattle may proceed into or out of or the combination thereof, of the fenced-off area bounded by fence 39 may be controlled merely by locking one of trigger gates 45 or 47 and one of the above latches and leaving the other one unlocked.

It has been found that cattle readily learn to pass through unlocked trigger gates in the directions indicated by arrows 56 and 52 if the corresponding latches are unengaged. The cattle quickly learn not to attempt to open the trigger gates in the reverse direction, and do not injure themselves on the protruding ends of the trigger gates. The hinging apparatus of the present invention has been found suitable for constructing highly reliable, maintenance free cattle triggers on ranches in the arid Southwestern portions of the United States with minimum overall expense.

While the invention has been described with reference to several particular embodiments thereof, those skilled in the art can modify arrangements of elements to produce similar devices without departing from the true spirit and scope of the invention, which is intended to be limited only by the following claims.

I claim:

1. A self-closing hinging apparatus for attaching a gate to a vertical upright, said gate having a first vertical edge and an opposite second vertical edge, said hinging apparatus comprising in combination:

a. an upper hinge including a first hinge joint and first and second leaves attached to said first hinge joint, said first leaf having a first attachment end for attachment to an upper portion of said vertical upright and said second leaf having a second attachment end for attachment to an upper portion of said gate;

b. a lower hinge including a second hinge joint and third and fourth leaves attached to said second hinge joint, said third leaf having a third attachment end for attachment to a lower portion of said vertical upright, said fourth leaf having a fourth attachment end for attachment to a lower portion of said gate, the distance between said first hinge joint and said second attachment end being approximately equal to a first distance, the distance between said second hinge joint and said fourth attachment end being approximately equal to a second distance, said second distance being substantially greater than said first distance; and c. a reinforcing member rigidly attached to said upper hinge and said lower hinge adjacent said first hinge joint and second hinge joint, respectively, for maintaining said first hinge joint in alignment with said second hinge joint, said first and second hinge joints having first and second axes, respectively, said first and second axes lying along a common straight line, said common straight line being inclined with respect to said vertical upright, said common straight line also being inclined with respect to a plane parallel to said gate, said first hinge joint resisting any removal of either of said first leaf and said second leaf in a lateral direction from said first hinge joint, said second hinge joint resisting any removal of either of said third leaf and said fourth leaf in a lateral direction from said second hinge joint.

2. The self-closing hinging apparatus of claim 1 wherein said upper and lower hinges are attached to said vertical upright so that said first and third leaves lie in a plane perpendicular to said gate.

3. The self-closing hinging apparatus of claim 2 wherein said upper and lower hinges are composed of metal and said reinforcing means includes a rigid rod welded to said upper and lower hinges adjacent said first and second hinge joints, respectively.

4. The self-closing hinging apparatus of claim 2 wherein the distance between said first hinge joint and said first attachment end is equal to said first distance and the distance between said second hinge joint and said third attachment end is equal to said second distance.

5. The self-closing hinging apparatus of claim 2 wherein said first leaf and said third leaf are of approximately equal length and wherein said first leaf and said second leaf are rigidly attached to said reinforcing member, said reinforcing member being an elongated plate for attachment to said vertical upright, said elongated plate lying in a plane perpendicular to said gate when said gate is closed, said elongated plate being attached to said vertical upright at such an angle that said gate is in vertical alignment with said vertical upright when said gate is closed.

6. The self-closing hinging apparatus of claim 2 wherein said second distance is sufficiently greater than said first distance to ensure that said gate closes at a predetermined rate in response to the force of gravity upon the weight of said gate.

7. The self-closing hinging apparatus of claim 1 incorporated into a cattle trigger.

* * * * *